US009748067B2

(12) United States Patent
Berk et al.

(10) Patent No.: US 9,748,067 B2
(45) Date of Patent: Aug. 29, 2017

(54) POSITIONING APPARATUS FOR AN ELECTRON BEAM

(71) Applicants: Jan Berk, Hohenroda (DE); Thomas Weidinger, Erlangen (DE)

(72) Inventors: Jan Berk, Hohenroda (DE); Thomas Weidinger, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 196 days.

(21) Appl. No.: 14/709,068

(22) Filed: May 11, 2015

(65) Prior Publication Data

US 2015/0340191 A1 Nov. 26, 2015

(30) Foreign Application Priority Data

May 20, 2014 (DE) ..... 10 2014 209 539

(51) Int. Cl.

| | |
|---|---|
| ***H01J 29/00*** | (2006.01) |
| ***H01J 29/98*** | (2006.01) |
| ***H05G 1/66*** | (2006.01) |
| *H01J 29/70* | (2006.01) |
| *H01J 35/14* | (2006.01) |
| *H01J 3/26* | (2006.01) |

(52) U.S. Cl.

CPC ..... *H01J 29/98* (2013.01); *H05G 1/66* (2013.01); *H01J 3/26* (2013.01); *H01J 29/70* (2013.01); *H01J 35/14* (2013.01)

(58) Field of Classification Search

CPC .... H01J 29/98; H01J 3/26; H01J 35/14; H01J 29/70; H05G 1/66

USPC ..... 250/396 R, 396 ML

See application file for complete search history.

(56) References Cited

U.S. PATENT DOCUMENTS

| | | | | |
|---|---|---|---|---|
| 5,550,442 | A * | 8/1996 | Ueyama | G09G 1/04 315/371 |
| 5,747,949 | A * | 5/1998 | Gyoten | H04N 3/26 315/382.1 |
| 2004/0208287 | A1 | 10/2004 | Deuringer | |
| 2012/0027164 | A1 * | 2/2012 | Caiafa | H01J 35/10 378/16 |

(Continued)

FOREIGN PATENT DOCUMENTS

| | | |
|---|---|---|
| CN | 1140377 A | 1/1997 |
| CN | 102347189 A | 2/2012 |

(Continued)

OTHER PUBLICATIONS

Chinese office Action for related Chinese Application No. 201510212329.9 dated Aug. 31, 2016, with English Translation.

(Continued)

*Primary Examiner* — Michael Maskell

(74) *Attorney, Agent, or Firm* — Lempia Summerfield Katz LLC

(57) ABSTRACT

A positioning apparatus is provided for an electron beam of an electron tube, the apparatus including a first DC voltage circuit having a high potential difference and a second DC voltage circuit having a smaller potential difference, having in each case a first potential level and a second potential level, and a deflection module, which has two inputs and at least one deflection coil, wherein the at least one deflection coil is connected between the two inputs of the deflection module.

14 Claims, 2 Drawing Sheets

(56) References Cited

U.S. PATENT DOCUMENTS

| | | | | |
|---|---|---|---|---|
| 2012/0027165 | A1* | 2/2012 | Caiafa | H05G 1/52 378/16 |
| 2013/0051532 | A1* | 2/2013 | Caiafa | H01J 35/18 378/110 |

FOREIGN PATENT DOCUMENTS

| | | | |
|---|---|---|---|
| CN | 103458153 | A | 12/2013 |
| DE | 10301068 | B4 | 9/2006 |
| DE | 102011052243 | A1 | 2/2012 |

OTHER PUBLICATIONS

German Office Action for German Application No. 10 2014 209 539.5, mailed Mar. 5, 2015, with English Translation.

* cited by examiner

POSITIONING APPARATUS FOR AN ELECTRON BEAM

CROSS-REFERENCE TO RELATED APPLICATIONS

This application claims the benefit of DE 10 2014 209 539.5, filed on May 20, 2014, which is hereby incorporated by reference in its entirety.

TECHNICAL FIELD

The embodiments relate to a positioning apparatus for an electron beam of an electron tube, (e.g., an X-ray tube), including a deflection module having two inputs and at least one deflection coil, wherein the at least one deflection coil is connected between the two inputs of the deflection module.

BACKGROUND

In order to generate X-ray radiation in an imaging medical facility, (e.g., in a computed tomography scanner), X-ray tubes are used. In the X-ray tube, a heated cathode emits electrons that are accelerated by a high voltage of 20 kV-200 kV towards an anode. On impinging on the anode, the electrons enter the anode material. In this case, two types of X-ray radiation may be generated. As a result of energy conservation, the bremsstrahlung is emitted as a continuous spectrum on deceleration of the electrons in the anode material. Furthermore, the electron beam ionizes atoms in the anode material, which results in transfers of fixed energy levels and, as a result, emission of the characteristic X-ray radiation takes place. This has a linear spectrum. In medical applications, the bremsstrahlung is used widely so that efficient manipulation of this radiation plays a key role.

Since the X-ray with conventional optical components may not be oriented in optimum fashion as a result of the short wavelengths, the electron beam may be focused and directed to a specific point on the anode surface. The properties and orientation of the anode and the anode material used in this case have an effect on the direction and the ray profile of the generated X-ray. In particular, the position of the focal spot, (e.g., the zone in which the electron beam impinges on the anode), may in this case be mentioned as an important control parameter.

In order to deflect the electron beam, but also to focus said electron beam, magnetic fields may be used. The magnetic fields are generated by deflection coils, for example, which are arranged between the cathode and the anode around the electron beam or the X-ray tube. Depending on the anode geometry and on requirements for the sharpness of the focusing or for the focal spot contour, one or more deflection coils may be provided.

In this case, a current in the respective deflection coils is varied as manipulated variable for the position and the profile of the electron beam. Only the so-called flying focal spot method, which is characterized by targeted periodic shifting of the focal spot, may include a rectangular current profile in the respective deflection coil, which rectangular current profile has a high rate of rise in the edges and as small fluctuations as possible in the plateau.

A circuit including a full bridge or a half bridge may be used for this purpose, the circuit being connected at its input terminals to a DC voltage circuit, wherein the respective deflection coil is interconnected, for example, between the two output terminals of the full bridge or from an output terminal of the half bridge to ground. For current regulation, pulse width modulation may be used. In order to generate a current pulse that is as rectangular as possible in the deflection coil, the DC voltage source is applied to the deflection coil until the desired current is reached, and the voltage is then switched over to another value.

For the desired rate of rise of the current in the edges, a voltage in the DC voltage circuit that is as high as possible is provided. Whilst maintaining the current, the high voltage applied in pulsed form generates fluctuations in the current flow, however, which in turn result in fluctuations in the magnetic flux through the deflection coil. However, these fluctuations are undesirable since, as a result, the quality of the focusing or positioning of the electron beam and therefore ultimately the quantity of the X-ray deteriorates.

SUMMARY AND DESCRIPTION

The scope of the present invention is defined solely by the appended claims and is not affected to any degree by the statements within this summary. The present embodiments may obviate one or more of the drawbacks or limitations in the related art.

The object of the embodiments consists in being able to position the focal spot of an electron beam in an electron tube, (e.g., in an X-ray tube), as stably as possible and in the process nevertheless to achieve high dynamics for the positioning The mentioned object is achieved by a positioning apparatus for an electron beam in an electron tube, (e.g., in an X-ray tube), including a first DC voltage circuit having a high potential difference and a second DC voltage circuit having a smaller potential difference, having in each case a first potential level and a second potential level. The positioning apparatus further includes a deflection module having two inputs and at least one deflection coil. The at least one deflection coil is connected between the two inputs of the deflection module. The first potential level of the first DC voltage circuit is connected switchably to an input of the deflection module and as a result a first switching path is formed, and the second potential level of the first DC voltage circuit is connected to the remaining input of the deflection module. The first potential level of the second DC voltage circuit is connected switchably to an input of the deflection module and, as a result, a second switching path is formed, which is switchable separately from the first switching path. In this case, the second potential level of the second DC voltage circuit is connected to the remaining input of the deflection module.

In this case, a deflection coil refers to a magnet coil, which is configured and designed to deflect an electron beam. A switchable connection refers to a connection in which a current or electron flow in the direction of the DC voltage may be produced or suppressed switchably in targeted manner. An electron return flow counter to the DC voltage of the corresponding DC voltage circuit may in this case be permanently possible, if appropriate. The term interconnection refers to a connection that may be permanent or switchable in the above sense. In particular, a direct connection of the two inputs via the at least one deflection coil may exist correspondingly in the deflection module, or a current flow through the at least one deflection coil in the direction of a DC voltage applied to the inputs may be produced by switching. The deflection module may be configured in such a way that the direction of current flow, which is brought about by a DC voltage applied to the inputs in the at least one deflection coil of the deflection module, is freely selectable by switching The mentioned object is likewise achieved by a method for actuating, by pulse width modulation, an above-described positioning apparatus for an electron beam in an electron tube, (e.g., in an X-ray tube). In a first cycle, the first potential level of the first DC voltage circuit is connected to at least one deflection coil by switching until a first threshold value for the current is exceeded in said deflection coil. In a plurality of further cycles, the first potential level of the second DC voltage circuit is connected, by switching, to the at least one deflection coil until a second threshold value for the current is exceeded in said deflection coil. In particular, the deflection coil needs to be disconnected from the respective DC voltage circuit when the corresponding threshold value is exceeded. In particular, the first threshold value and the second threshold value may also be identical. However, implementation of the method using two different threshold values is also explicitly provided.

In this case, the embodiments are based on the following considerations.

In order to generate a current profile that is as rectangular as possible in the or each deflection coil for stable flying focal spot focusing of an electron beam in an electron tube by pulse width modulation (PWM), a voltage that is as high as possible in a DC voltage circuit is advantageous. For a sufficiently high inductance of a deflection coil and a comparatively low ohmic resistance, the current profile in the deflection coil during the applied voltage pulse may be described by the linearized equation for the switch-on operation of a coil: $i_L=U\cdot t/L$, where $i_L$ is the current in the deflection coil, L is the inductance of said deflection coil, U is the applied voltage, and t is the time after application of the voltage. It may be seen from this that a current generated by a correspondingly high voltage pulse U quickly reaches a desired value in a deflection coil of a given inductance. Therefore, a low duty factor may be selected in the corresponding pulse, and the current in the coil then has a high rate of rise in the edges.

Once the desired current has been reached, the voltage applied to the deflection coil may now be switched off in such a way that the current exponentially relaxes. Under the abovementioned conditions, the relaxation may be described by the linearized equation for the switch-off operation of a coil: $i_L=I_0\cdot(1-R_L.t/L)$, where $R_L$ is the ohmic resistance of the deflection coil, t is the time after disconnection of the voltage, and $I_0$ is the current flowing in the coil at the time of disconnection (which current has been built up by the previously applied voltage). Alternatively, the voltage may also be applied to the deflection coil in the reverse direction in order to reduce the current through the coil, wherein in this case the decrease in the current takes place more quickly. The described effects may also be derived from the precise, exponential equations.

It may be seen from this that, in order to maintain a current in the coil with a value that is as constant as possible around $I_0$ owing to the relaxation, the voltage U needs to be connected again and again for a short period of time. However, the higher the applied DC voltage U, the steeper the rise of the current that is intended to be maintained by the voltage in the coil. Since the current in the respective deflection coil needs to be kept as constant as possible for as small as possible a movement of the focal spot position, in the case of a high applied voltage correspondingly short connection phases and therefore high switching frequencies are required. The high number of switching operations results in switching losses, however, which are undesirable.

By way of contrast, a first DC voltage circuit with a high potential difference and a second DC voltage circuit with a relatively low potential difference may be provided, which are each connected to an input of the deflection module switchably, separately from one another, with the at least one deflection coil being interconnected between the inputs of said deflection module. This opens up the possibility of the rate of rise in the edges in the current profile being achieved during actuation of the at least one deflection coil via a PWM method in that the first DC voltage circuit is connected to the deflection module and therefore a high voltage pulse may be applied to a deflection coil in the deflection module. Furthermore, however, the possibility is provided whereby, when the desired current is reached, this current is maintained by virtue of the fact that the second DC voltage circuit is connected to the deflection module and therefore a relatively low voltage pulse may be applied to a deflection coil in the deflection module, as a result of which the fluctuations in the current flow through the deflection coil may be comparatively reduced.

The deflection module may have a full bridge including a first input terminal and a second input terminal and a first output terminal and a second output terminal, wherein both the first input terminal and the second input terminal are connected to in each case one input of the deflection module, and wherein the at least one deflection coil is connected between the first output terminal and the second output terminal. This has the advantage that the direction of current flow through the at least one deflection coil that is intended to be brought about by a DC voltage applied to the input terminals and corresponding switching in the full bridge, may be selected freely by switching operations that may be implemented within the full bridge. Therefore, when the direction of current flow in a deflection coil is intended to be changeable, it is possible to dispense with complex circuitry beyond the switching paths.

Favorably, the first switching path and the second switching path end at the same input of the deflection module. This provides, in particular, that the respective first potential levels of the first and second DC voltage circuits are connected switchably to the same input of the deflection module. This opens up the possibility of interconnecting the remaining input directly to the respective second potential level of the two DC voltage circuits. As a result, the two second potential levels of the two DC voltage circuits are brought to the same potential, as a result of which, during operation, drift of a potential is made more difficult, and as a result the operation becomes more stable.

It has proven to be advantageous if the first switching path has a first switch, (e.g., a semiconductor switch), and the second switching path has a second switch, (e.g., a semiconductor switch). By virtue of mentioned switches, (e.g., semiconductor switches), the voltages occurring may be switched in a particularly quick and controlled manner.

Expediently, a diode is connected back-to-back in parallel with the first switch and/or a diode is connected in parallel with the second switch. The terms back-to-back in parallel and parallel are to be understood here and below with respect to the direction provided in the respective switching path by the voltage of the DC voltage circuit. Such a diode may discharge a return current flow out of a deflection coil in the direction of a DC voltage circuit and thus decrease a possible overvoltage at a semiconductor switch before there is a risk of said semiconductor switch becoming damaged.

In the first switching path, a coil and a diode connected back-to-back in parallel therewith may be connected. This measure improves electromagnetic compatibility.

It has proven to be further advantageous if the ratio of the voltage drop across the second DC voltage circuit contributes to the voltage drop across the first DC voltage circuit by up to 1:4 or up to 1:8. Such a low ratio makes it possible in a PWM method to generate a current profile in a deflection coil that has a high rate of rise in the edges by virtue of a sufficiently high voltage in the first DC voltage circuit, and in the process nevertheless to keep the fluctuations in the plateau caused by pulses of the relatively low voltage of the second DC voltage circuit sufficiently small.

Favorably, a current measuring device is connected on the input and/or output side of the deflection coil or each deflection coil. This enables efficient control of the current through the deflection coil, which is advantageous in particular in the case of a PWM method.

In an advantageous configuration of the method, in order to determine the respective duty factor of the switching time for exceeding the first threshold value in the first cycle and for exceeding the second threshold value in the plurality of further cycles, a number of characteristic parameters of the at least one deflection coil is used. In particular, in this case the duty factor of the switching time may be determined in the first cycle and in the plurality of further cycles from the inductance and the ohmic resistance of the deflection coil in conjunction with the voltage of the respective DC voltage circuit. Such a procedure has the advantage that it may be performed without external regulation of the current, which reduces the system complexity.

In a further advantageous configuration of the method as an alternative to this, a current flowing through the at least one deflection coil is measured, the measured current is compared with the first threshold value in the first cycle and with the second threshold value in a plurality of further cycles and is used in this case to determine the respective duty factor of the switching time. By virtue of the respective duty factor for the voltage to be applied in each case being determined from a current measured in a deflection coil, a high degree of control over the current and therefore also over the magnetic flux in the deflection coil is provided.

The embodiments furthermore specify an X-ray tube, which includes an electron source for generating an electron beam, an above-described positioning apparatus for positioning the electron beam, and a control apparatus, which is designed to implement the above-described method. The advantages specified for the positioning apparatus and its developments and the advantages specified for the method and its developments may in this case be transferred accordingly to the X-ray tube.

BRIEF DESCRIPTION OF THE DRAWINGS

Mutually corresponding parts and variables have each been provided with the same reference symbols in all of the figures.

DETAILED DESCRIPTION

Figure 1:
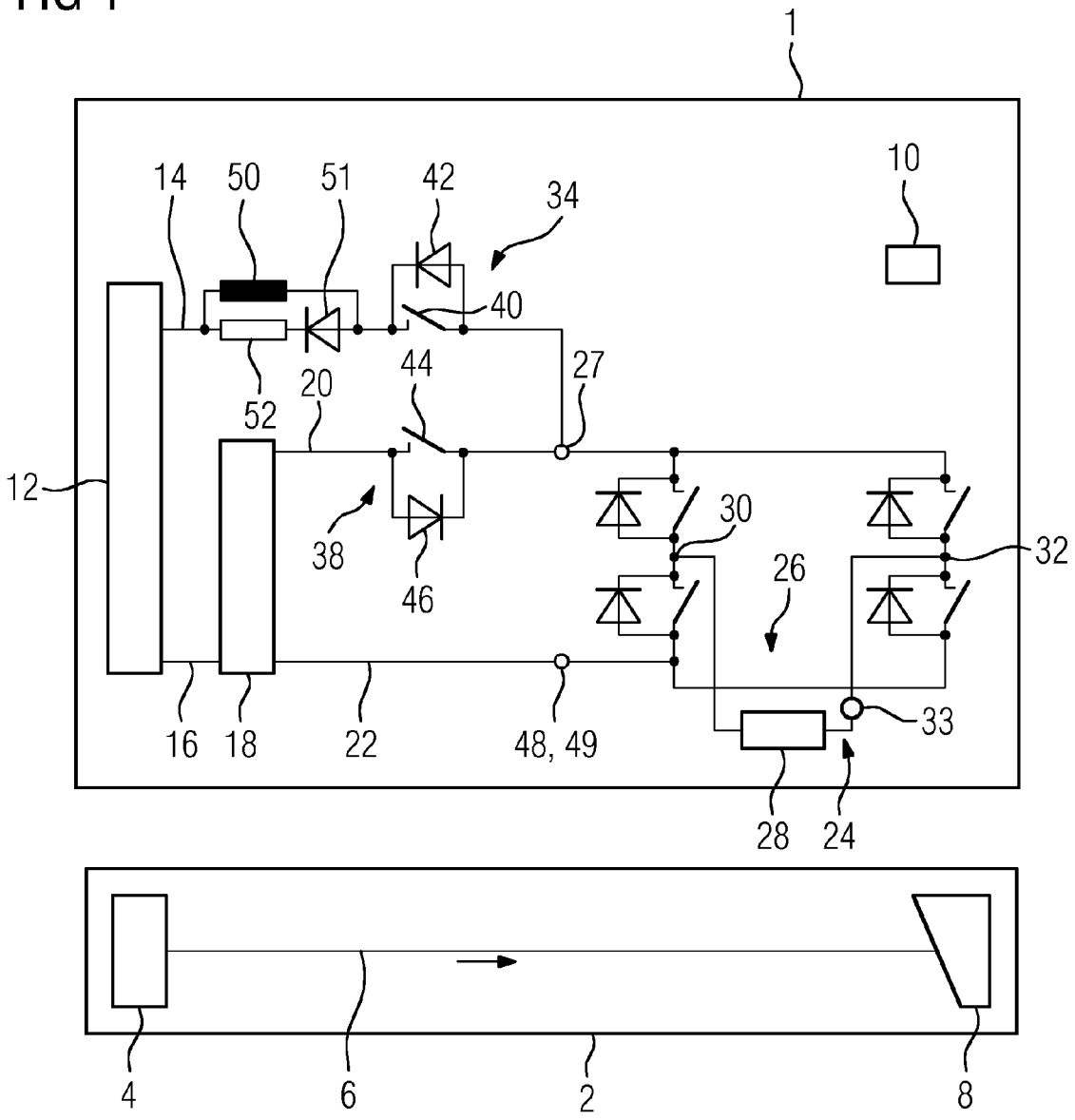
FIG. 1 depicts an example of a positioning apparatus for an electron beam of an X-ray tube.

FIG. 1 depicts schematically a positioning apparatus 1. An X-ray tube 2 has an electron source 4, which generates an electron beam 6. The electron beam 6 is accelerated onto the anode 8, wherein the focal spot position is regulated via the positioning apparatus 1 by a method yet to be illustrated in more detail, which is controlled by the control apparatus 10.

The positioning apparatus 1 has a first DC voltage circuit 12 including a first potential level 14 and a second potential level 16 and a second DC voltage circuit 18 including a first potential level 20 and a second potential level 22. Furthermore, the positioning apparatus 1 has a deflection module 24, which is formed substantially by a full bridge 26 and a deflection coil 28. In this case, the deflection coil 28 is connected in series with a current measuring device 33 between the first output terminal 30 and the second output terminal 32 of the full bridge 26. A first switching path 34 leads from the first potential level 14 of the first DC voltage circuit 12 to the first input terminal 36 of the full bridge 26. A second switching path 38 leads from the first potential level 20 of the second DC voltage circuit 18 to that input 37 of the deflection module formed by the first input terminal 36 of the full bridge 26.

In this case, the first switching path 34 has a first switch 40 and a diode 42 connected back-to-back in parallel therewith. The second switching path 38 has a second switch 44 and a diode 46 connected in parallel therewith. The second potential level 16 of the first DC voltage circuit 12 and the second potential level 22 of the second DC voltage circuit 18 are connected jointly to that input 49 of the deflection module 24 formed by the second input terminal 48 of the full bridge 26. Furthermore, the first switching path 34 includes a coil 50 and a diode 51, which is connected back-to-back in parallel therewith and with which a resistor 52 is connected in series.

In order to generate a current with as steep edges as possible by PWM in the deflection coil 28 of the deflection module 24, the first switch 40 in the first switching part 34 may be closed and the second switch 44 in the second switching path 38 may be opened. As a result, the entire deflection module 24 is present at the first DC voltage circuit 12, and the fine adjustment for the duty factor may be performed, for example, by corresponding switching of the full bridge 26. In order to keep the current in the deflection coil 28 stable with as few fluctuations as possible by PWM, the second switch 44 may be closed and the first switch 40 opened, correspondingly. As a result, the deflection module 24 is only present at the second DC voltage circuit 18, and is disconnected from the first DC voltage circuit 12. The fine adjustment of the respective duty factor may likewise be performed by switching in the full bridge 28.

Figure 2:
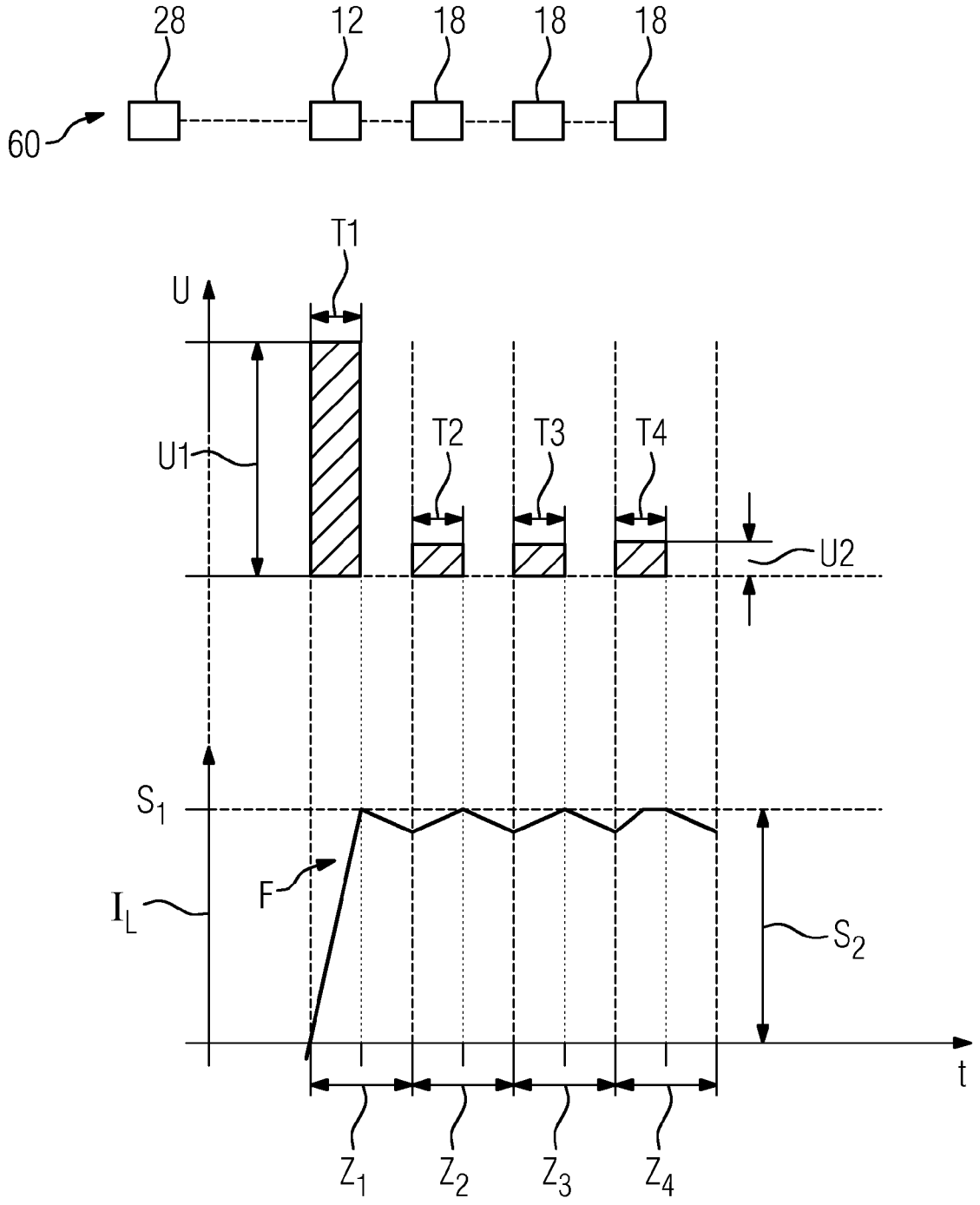
FIG. 2 depicts an example of a current profile generated by a method for actuating, by pulse width modulation, a positioning apparatus as depicted in FIG. 1.

FIG. 2 depicts a current profile $I_L$ generated by a method 60 for actuating, by pulse width modulation, a positioning apparatus as depicted in FIG. 1. The method 60 envisages applying the deflection coil 28 to the first DC voltage circuit 12 in a manner not illustrated in any more detail in a first cycle $Z_1$. This may take place, for example, by virtue of the fact that the first switch in the first switching path is closed, and therefore both inputs of the deflection module are initially applied to the first DC voltage circuit 12. Then, by corresponding switching within the full bridge, the voltage present at the inputs of the deflection module may also be applied to the deflection coil.

In the first cycle $Z_1$, the voltage $U_1$ of the first DC voltage circuit 12 is present at the deflection coil 28, as a result of which the current in the deflection coil 28 increases until it reaches a first threshold value $S_1$. The voltage $U_1$ is clamped again by the deflection coil 28, and the deflection coil 28 is short-circuited via two switches of the full bridge. The duty factor $T_1$, namely the length for which the voltage $U_1$ is to be applied, may be calculated in this case, for example, from the inductance and the ohmic resistance of the deflection coil 28, or the current $I_L$ may be measured explicitly for this. After clamping of the voltage $U_1$ and short-circuiting of the deflection coil 28, the current $I_L$ in the deflection coil 28 decreases. At the beginning of the next cycle $Z_2$, the deflection coil 28 is applied to the second DC voltage circuit 18, so that the voltage drop $U_2$ there may again increase the current $I_L$ in the deflection coil 28 until, after a duty factor $T_2$, a second threshold value $S_2$ is reached. Then, the deflection coil 28 is clamped by the voltage $U_2$ up to the end of the cycle $Z_2$ and the deflection coil 28 is short-circuited, so that the current $I_L$ decreases again, and at the beginning of the third cycle $Z_3$ is again applied to $U_2$ until the current $I_L$ again reaches the second threshold value $S_2$. This procedure may be continued schematically in a comparable manner in further cycles $Z_4$, . . . , et al.

While the current $I_L$ has a comparatively steep edge F during rise in the first cycle $Z_1$ as a result of the high applied voltage $U_1$, in the further cycles $Z_2$, $Z_3$, $Z_4$, the profile of the current $I_L$ is characterized by a plateau P with relatively small fluctuations. The stable profile in the plateau P may be attributed to the low voltage $U_2$ present for comparatively long duty factors $T_2$, $T_3$, $T_4$ in the corresponding cycles $Z_2$, $Z_3$, $Z_4$. If the current $I_L$ in the deflection coil 28 is intended to be set to a radically different value, this may take place again by virtue of the deflection coil 28 again being applied to the first DC voltage circuit 12 with a corresponding duty factor. The subsequent stabilization of the current $I_L$ in the case of the new value then again takes place in the above-described way by the voltage $U_2$ of the second DC voltage circuit 18.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A positioning apparatus for an electron beam of an electron tube, the positioning apparatus comprising:

a first DC voltage circuit comprising a high potential difference, a first potential level, and a second potential level;

a second DC voltage circuit comprising a smaller potential difference, a first potential level, and a second potential level, wherein a ratio of a voltage drop across the second DC voltage circuit contributes to a voltage drop across the first DC voltage circuit by up to 1:4; and a deflection module comprising two inputs and at least one deflection coil, the at least one deflection coil connected between the two inputs, wherein the first potential level of the first DC voltage circuit is connected switchably to one of the two inputs of the deflection module to provide a first switching path, and the second potential level of the first DC voltage circuit is connected to a second of the two inputs of the deflection module, and wherein the first potential level of the second DC voltage circuit is connected switchably to one of the two inputs of the deflection module to provide a second switching path, which is switchable separately from the first switching path, and the second potential level of the second DC voltage circuit is connected to a second of the two inputs of the deflection module.

2. The positioning apparatus as claimed in claim 1, wherein the deflection module comprises a full bridge comprising a first input terminal, a second input terminal, a first output terminal, and a second output terminal, wherein both the first input terminal and the second input terminal are connected to one of the two inputs of the deflection module, and wherein the at least one deflection coil is connected between the first output terminal and the second output terminal.

3. The positioning apparatus as claimed in claim 2, wherein the first switching path and the second switching path end are at a same input of the deflection module.

4. The positioning apparatus as claimed in claim 3, wherein the first switching path comprises a first semiconductor switch, and the second switching path comprises a second semiconductor switch.

5. The positioning apparatus as claimed in claim 4, wherein a first diode is connected back-to-back in parallel with the first switch, a second diode is connected in parallel with the second switch, or the first diode is connected back-to-back in parallel with the first switch and the second diode is connected in parallel with the second switch.

6. The positioning apparatus as claimed in claim 5, wherein a coil and a diode connected back-to-back in parallel are connected in the first switching path.

7. The positioning apparatus as claimed in claim 1, wherein the first switching path and the second switching path end are at a same input of the deflection module.

8. The positioning apparatus as claimed in claim 1, wherein the first switching path comprises a first semiconductor switch, and the second switching path comprises a second semiconductor switch.

9. The positioning apparatus as claimed in claim 8, wherein a first diode is connected back-to-back in parallel with the first switch, a second diode is connected in parallel with the second switch, or the first diode is connected back-to-back in parallel with the first switch and the second diode is connected in parallel with the second switch.

10. The positioning apparatus as claimed in claim 1, wherein a coil and a diode connected back-to-back in parallel are connected in the first switching path.

11. The positioning apparatus as claimed in claim 1, wherein a current measuring device is connected on an input side, an output side, or the input side and the output side of the at least one deflection coil.

12. A method for actuating, by pulse width modulation, a positioning apparatus for an electron beam in an electron tube, the positioning apparatus comprising (1) a first DC voltage circuit comprising a high potential difference, a first potential level, and a second potential level, (2) a second DC voltage circuit comprising a smaller potential difference, a first potential level, and a second potential level, and (3) a deflection module comprising two inputs and at least one deflection coil, the at least one deflection coil connected between the two inputs, the method comprising:

connecting, in a first cycle, the first potential level of the first DC voltage circuit to the at least one deflection coil by switching until a first threshold value for the current is exceeded in the deflection coil;

connecting, in a plurality of further cycles, the first potential level of the second DC voltage circuit by switching to the at least one deflection coil until a second threshold value for the current is exceeded in the deflection coil; and determining a respective duty factor of a switching time for exceeding the first threshold value in the first cycle and for exceeding the second threshold value in the plurality of further cycles using a number of characteristic parameters of the at least one deflection coil.

13. The method as claimed in claim 12, further comprising measuring a current flowing through the at least one deflection coil with a current measuring device connected on an input side, an output side, or the input side and the output side of the at least one deflection coil;

comparing the measured current with the first threshold value in the first cycle and with the second threshold value in a plurality of further cycles; and determining the respective duty factor of the switching time using the compared measured current.

14. An X-ray tube comprising:

an electron source for generating an electron beam, a positioning apparatus focusing the electron beam, the positioning apparatus comprising: (1) a first DC voltage circuit comprising a high potential difference, a first potential level, and a second potential level; (2) a second DC voltage circuit comprising a smaller potential difference, a first potential level, and a second potential level, wherein a ratio of a voltage drop across the second DC voltage circuit contributes to a voltage drop across the first DC voltage circuit by up to 1:4; and (3) a deflection module comprising two inputs and at least one deflection coil, the at least one deflection coil connected between the two inputs; and a control apparatus configured to: (1) connect, in a first cycle, the first potential level of the first DC voltage circuit to the at least one deflection coil by switching until a first threshold value for the current is exceeded in the deflection coil; and (2) connect, in a plurality of further cycles, the first potential level of the second DC voltage circuit by switching to the at least one deflection coil until a second threshold value for the current is exceeded in the deflection coil.

* * * * *